US005368109A

United States Patent [19]

Pittard, Jr. et al.

[11] Patent Number: 5,368,109

[45] Date of Patent: Nov. 29, 1994

[54] APPARATUS FOR ARCUATE DRILLING

[75] Inventors: Frederick J. Pittard, Jr., Richmond; Albert E. Roos, Jr., Houston; Roger C. Leaf, Houston; Steven W. Drews, Houston, all of Tex.

[73] Assignee: Slim Dril International Inc., Houston, Tex.

[21] Appl. No.: 145,579

[22] Filed: Nov. 4, 1993

[51] Int. Cl.[5] ..... E21B 7/08; E21B 4/02; E21B 17/16

[52] U.S. Cl. ..... 175/45; 175/75; 175/61; 175/107; 175/320

[58] Field of Search ..... 175/107, 45, 73, 74, 175/75, 320, 321, 61, 62, 40, 41

[56] References Cited

U.S. PATENT DOCUMENTS

| | | | |
|---|---|---|---|
| 3,260,318 | 7/1966 | Neilson et al. | 175/75 |
| 3,563,323 | 2/1971 | Edgecombe | 175/107 X |
| 3,572,771 | 3/1971 | Redwine | 175/320 X |
| 3,667,556 | 6/1972 | Henderson | 175/73 |
| 4,577,701 | 3/1986 | Dellinger | 175/61 |
| 5,163,521 | 11/1992 | Pustanyk et al. | 175/107 X |
| 5,311,952 | 5/1994 | Eddison et al. | 175/107 X |

*Primary Examiner*—Stephen J. Novosad
*Attorney, Agent, or Firm*—Neal J. Mosely

[57] ABSTRACT

A system of apparatus for arcuate drilling into the earth is disclosed which comprises a drill string extending into a well bore in the earth and a fluid operated drill motor and drill bit operated thereby secured on the bottom end of the drill string. The drill motor is connected at its upper end to the drill string and at its lower end to the drill bit for rotating the drill bit independently of rotation of the drill string. The drill motor has a tubular drive section housing constructed of non-magnetic material, preferably a Beta-C titanium alloy containing titanium, aluminum, vanadium, chromium, zirconium and molybdenum in the proportions Ti-3Al-8V-6Cr-4Zr-4Mo. The longitudinal axis of the drill motor housing has its upper and lower ends angularly displaced from the longitudinal axis of its central portion end for directing the axis of rotation of the drill bit such that it is angularly displaced from the axis of the drill string for effecting a curved path for the wellbore. An orienting/circulating/float sub constructed of non-magnetic material, preferably Beta-C titanium alloy, connected above the drill motor. A drill collar constructed of non-magnetic material, preferably Beta-C titanium alloy, is connected to the upper end of the orienting/circulating/float sub. The drill collar may be of a one-piece Beta-C titanium alloy with integral threaded ends or may have separate threaded end pieces of steel or Beta-C titanium alloy welded thereon. A survey tool is positioned in and surrounded by the orienting/circulating/float sub. A drilling rig, instruments and controls positioned on the earth surface and connected by wire lines and a wet connect to the survey tool. The structure and configuration of the respective components cooperate to facilitate bending through a radius of curvature as short as 20 feet.

24 Claims, 7 Drawing Sheets

APPARATUS FOR ARCUATE DRILLING

FIELD OF THE INVENTION

This invention relates to new and useful improvements in apparatus for flexible and deviated and horizontal drilling at substantial depths in the earth and more particularly to apparatus constructed largely of non-magnetic material (titanium) to permit guidance equipment to be positioned closer to the drill bit and having a unique construction for drilling around a curve of very short radius.

BRIEF DESCRIPTION OF THE PRIOR ART

It has been recognized that a number of advantages can be gained in drilling wells by employing a stationary drill pipe or drill string which has attached at its lower end a downhole motor, the drive section of which is connected to and rotates a drill bit. In such apparatus a fluid, e.g., air, foam, or a relatively incompressible liquid, is forced down the stationary drill pipe or drill string and one passing through the fluid-operated motor causes rotation of a shaft ultimately connected to the drilling bit. The drill string is held or suspended in such a manner that it does not rotate and therefore may be regarded as stationary. However, it is lowered in the well as drilling proceeds.

Horizontally recompleting an existing well can provide substantial economic benefits, i.e., increased production and reduced drilling costs. Specialized horizontal well bottom-hole assemblies developed by SlimDril International, Inc. operate in small casing sizes and utilize ordinary drill pipe and conventional drilling rigs. Many horizontal wells have been successfully competed using this system.

In 1985, SlimDril provided the tools for the first medium-radius Austin Chalk horizontal well ever drilled out of an existing well containing 5.5 inch casing. Over 4000 wells in the Austin Chalk contain 5.7 inch or smaller casing. Prior to the development of this system, horizontal wells could not be sidetracked from these vertical Austin Chalk wells. This slimhole technique, which uses a stationary drill pipe or drill string having a downhole motor at its lower end, the drive section of which is connected to and rotates a drill bit, has found widespread application and has created a drilling boom in the Austin Chalk.

The forces required to rotate the rotary bit at the bottom of the string are such that in the usual situation the fluid operated motor must be quite lengthy. Conventional straight hole drilling motors such as the Moineau (Moyno) motor comprise three sections, the rotor-stator section which contains a rubber stator and a steel rotor; the universal section which contains the universal joint or flexible connection that converts the orbiting motion of the rotor to the concentric rotary motion of the bit; and the bearing pack section which contains radial and thrust bearings to absorb the high loads applied to the drill bit. The rotor/stator section of the motor is typically 2–3 times longer than the bearing pack section.

In directional drilling, drilling motors of this general character are utilized wherein a bend may be located in the drill string above the motor, a bend may be placed in the motor housing below the rotor/stator drive section, or the bit or output shaft may be angularly offset relative to the drive section axis.

In some directional drilling systems, such as Dellinger et al, U.S. Pat. No. 4,577,701 and British Patent 1,494,273, suggestions have been made to position a "bent sub" between the top of the fluid-operated motor and the axis of rotation of the bit to the axis of the drill pipe. However, due to the length of the motor required and other structure connecting the rotor of the motor to the bit, the spacing of the "bent sub" from the bit is excessive. This distance frequently amounts to approximately 22 feet or more which is objectionable due to the fact that it is difficult to position and to maintain the orientation of the bit in relation to the axis of the drill pipe. In an attempt to overcome this problem other systems have been designed to place the bend closer to the bit, such as Whittier et al, U.S. Pat. No. 3,260,318.

These systems modify the universal section of the drilling motor. Because the lower end of the rotor in the aforementioned types of motors gyrate about the axis of its stator, some form of universal joint or flexible connection is employed in the driving connection between the rotor and the bit which rotates about a stationary axis. As a clearance must exist between this universal joint or flexible connection and the walls of the surrounding housing to accommodate the flexibility of movement, a bend is formed in the housing of the universal section of the motor. In this manner, the axis of rotation of the bit is angularly related not only to the axis of the drill string but also the axis of the fluid-operated motor. This aids in obtaining and maintaining control and orientation of the bit. However, placing the bend in the housing surrounding the universal joint limits the severity of the bend which can be used.

Other systems, such as Henderson, U.S. Pat. No. 3,667,556 and Kamp, European Patent 109,699 disclose apparatus wherein the drill bit or output shaft is angularly offset relative to the motor drive section axis. Maurer et al U.S. Pat. No. 4,823,053 shows an apparatus for drilling wells with a curvature of 200–2000 feet. Combinations of the above described prior art systems may also be used in directional drilling, however none utilize downhole fluid motors having a bent or curved rotor/stator section. Because the rotor/stator section of the motors are typically 2–3 times longer than the bearing section, the prior art systems are not particularly suitable for use in drilling high curvature horizontal wellbores, such as medium-radius (200 to 1,000 feet), from vertical or near vertical wells.

The slim-hole horizontal drilling system is finding widespread use in fractured reservoirs such as the Austin Chalk and in areas where water or gas coning is a problem. In many areas, horizontal wells produce 3 to 8-fold more oil or gas than vertical wells. Traditional horizontal technology involves the use of highly specialized, bottom hole assemblies. Prior to the development of the slim-hole system high lost-in-hole costs made horizontal recompletions economically unattractive. New horizontal well technology has focused on large-diameter wells and in equipment that can pass through the small diameter casing as found in most Austin Chalk wells.

The SlimDril system utilizes a mixture of existing technology and new innovations. The oil-field SlimDril system is a modification of a small diameter SlimDril steerable drilling system utilized extensively in the construction industry for drilling under rivers and other obstacles for pipeline installations. Modifications to these small diameter systems have produced a reliable, low-cost system for horizontally recompleting oil-field vertical wells in the Austin Chalk and other areas.

A number of types of bits are used with this slim-hole system. Side-tracking matrix bits with short gauges and natural diamonds are typically used to kick off from vertical wells. These sidetrack bits are designed to provide a rugged cutting surface while kicking off a cement plug or whipstock. HT-1 matrix bits utilizing either natural diamonds or thermally stable polycrystalline diamonds are used to drill the horizontal wells once they are kicked off. Roller cone bits and PCD (polycrystalline diamond) bits may also be used.

These bits provide good side cutting, high penetration rates, and long life in the curved sections of the horizontal holes and are designed specifically for use with high-speed mud motors. They virtually eliminate vibration problems experienced earlier with PCD (polycrystalline diamond) bits on high speed motors. In 1985, Austin Chalk wells were drilled at rates of 7 to 10 ft/hr using conventional straight-hole diamond bits, compared to drilling rates of 10 to 50 ft/hr with the sidetrack HT-1 TSD bits.

SlimDril used high-speed, positive-displacement hydraulic Moineau motors for horizontal drilling. These high-performance motors, designed specifically for use in horizontal wells, typically provide twice the power output of older slim-hole motors, resulting in longer life and high penetration rates. Bent housings ranging from 0° to $2\frac{1}{4}$° are used to vary the build rate. Deflection pads are often installed on the low side of the motors to increase the lateral loads on the bit and to help offset the effect of gravity. The pad thickness is varied as required. Bent subs (0° to 20°) are added above the motor in situations requiring high build rates. Although build rates of 10° to 20° are typically used in horizontal wells, planned build rates in excess of 20° per 100 ft have been achieved.

The SlimDril horizontal drilling system utilizes 350–900 RPM motors. The high-speeds are ideally suited for TSD bits since they produce high drilling rates with low-bit weights which allows the use of slick drill pipe above the motor and eliminates the use of expensive compressive service drill pipe. This is a major advantage, because the high-bit weights required with high-torque, low-speed motor systems necessitates the use of heavyweight drill pipe or compressive service drill pipe to prevent buckling of the drill pipe.

An orienting/circulating/float sub, containing a spline-key system is made up on the motor with the keyed spline aligned with the motor bend. The key provides a means for proper orientation of the steering tool. The circulating sub by-passes flow above the motor to eliminate tripping wet pipe. The sub remains closed during the drilling operation and is activated by dropping a ball through the drill string when the operation is complete.

A surface recording gyro is used to orient the tool-face direction before kicking off. This wireline tool allows readings of tool-face azimuth and inclination with the tool in the casing since its readings are not affected by magnetic interference. Once the kickoff assembly is oriented, the gyro must be pulled prior to drilling since it cannot survive the drilling vibrations of the motor.

Steering tools are normally used to survey the curved and horizontal portions of the slim-hole while drilling. These wireline tools allow continuous reading of tool-face azimuth and inclination. The azimuth reading is measured with three magnetometers and the inclination is measured with three accelerometers. Measuring while drilling (MWD) tools are sometimes used instead of wireline steering tools in holes larger than 5-in. diameter. Smaller MWD tools are under development for use in small diameter holes.

A drill collar constructed of high-strength, non-magnetic monel is used to isolate the steering tool from the magnetic interference of the steel drill pipe located above it. A side-entry sub provides a method of drilling with a wireline survey tool without having to splice the wireline or pulling the survey tool each time a joint of pipe is added to the drill string. The wireline is threaded into the side-entry sub and attached to the steering tool. The steering tool is then run through the drill string and seated into the orienting sub. Drilling commences with the wireline outside of the drill string from the side-entry sub to the surface. Joints of drill pipe can therefore be added to the drill string while drilling without pulling the survey tool.

The horizontal re-entry drilling operation normally takes place in three steps: kickoff, build section, and horizontal section. The kickoff is the most critical part of the operation. An error at this stage can result in major problems since the initial direction is being established during kickoff.

Once the kickoff point has been determined, two different techniques are used for kickoff. The preferred method is to mill out a section of the casing, set a cement plug at the kickoff point, and sidetrack off of the cement plug. Most of the wells drilled with the SlimDril system utilize this procedure.

The second kickoff method is to set a whipstock inside the casing at the kickoff point, mill a window in the casing and then sidetrack through this window. Although this technique may be less costly, it has several disadvantages. Surface recording gyros are normally used to orient the kickoff assemblies since other tools are affected by the magnetism of the steel casing. The gyro is run down the drill string, set in the orienting sub, used to orient the tool-face, and then pulled since it cannot withstand drilling vibrations.

The steering tool is then run down the drill string, set in the orienting sub, and calibrated using the known tool-face orientation. Drilling commences and continues with this bottom hole assembly until all obstructions are cleared and the tool is far enough away from the casing to prevent magnetic interference (approximately 50–100 ft). The kick-off assembly is then pulled and replaced with the angle build assembly in preparation for drilling the build or curve section of the hole.

Tool-face orientation is continually monitored via steering etc. The angle-building assembly is normally the same as the kickoff assembly except that the sidetrack bit is replaced with an aggressive TSD side cutting HT-1 bit or, in very hard formations, with a side cutting natural diamond bit. Time drilling takes place at the start of the kick off assuring an accurate azimuth and inclination with respect to build rate. Tool-face orientation is continually monitored via steering or MWD tools as drilling progresses. If the BHA (bottom hole assembly) is building too rapidly, the tool-face is often oriented back and forth periodically to reduce the vertical build rate. Once the desired angle has been reached (90° for a horizontal hole), the angle-build assembly is pulled.

The angle-holding assembly used to drill the horizontal section of the hole utilizes a bent motor housing with a small angle (1° to 2°) to allow minor corrections to be made to as the horizontal section is drilled. No other angle-build components are typically used in the horizontal assembly. This assembly is used to target depth unless problems are encountered.

This horizontal drilling system has been used successfully in many applications. Numerous horizontal wells have been drilled in fractured reservoirs such as the Austin Chalk and Sprayberry fields. Horizontal wells are more successful than vertical wells in fractured reservoirs because it is difficult to intersect major vertical fractures with vertical wells whereas horizontal wells typically pass through two or three sets of vertical fractures. This system is also used to drill horizontal wells in reservoirs where gas or water coning is a problem. Horizontal wells have lower draw down pressures than vertical wells, thus allowing the horizontal wells to be produced at much higher rates without pulling gas or water into the well bore. The horizontal wells are placed near the top of the reservoir if only water coning exists, near the bottom if only gas coning exists and near the center if both gas and water coning exists.

SlimDril motors have been used to drill in tight formations and in heavy oil reservoirs. In these fields, the horizontal wells act as pipelines or conduits through the producing formations, greatly increasing formation exposure and production rates. SlimDril tools are also used to drill in inaccessible locations such as in mountainous areas, under rivers or lakes, and under urban areas.

The field results show that this slim-hole horizontal drilling system is reliable and economic in the Austin Chalk and other areas. In most areas, horizontal wells produce 3 to 8 times more oil and gas than vertical wells. The economic benefits of the method are high since the development cost per barrel is less than half that of vertical wells. In addition to increased production rates and reduced drilling costs, these recompletions may result in tax incentives since horizontal reentries are classified as an enhanced oil recovery procedure in many areas.

This slim hole drilling system has been very successful but there has been a need for improvement in the overall construction to permit arcuate drilling around very short radii and which is constructed of materials of superior strength which facilitates such short turns and which is non-magnetic so as to permit the installation of guidance equipment close to or ever ahead of the drilling motor.

Titanium is as strong as steel but 45% lighter; 60% heavier than aluminum but twice as strong. It has very low heat and electrical conductivities and is essentially non-magnetic. The metal resists corrosion by many acids, saltwater, and sea air, which makes it useful in corrosive environments. For aircraft and aerospace applications, titanium alloys have been developed with tensile strengths up to 200,000 lb/sq in with a weight of only 60% that of steel. Because of their high corrosion resistance and the absence of reactions with living tissues, titanium alloys are used in prosthetic devices and pacemakers.

Titanium has been available commercially relatively recently and became available largely as a technological fall out from the defense and space development efforts by the U.S. government. Production rose sharply from 3 tons in 1948 to an annual average of more than 20,000 tons of sponge metal in the early 1980s.

Titanium alloys are classified as alpha, alpha-beta, or beta according to the phases present in the alloy at room temperature. Where the alpha stabilizers, e.g., oxygen, nitrogen, hydrogen and/or carbon, are present, the alloys are generally of the alpha type. Alpha-beta alloys and beta alloys are obtained with increasing amounts of beta stabilizers, e.g., vanadium, molybdenum, iron, chromium, manganese, tantalum, and/or niobium. The alpha-beta alloys are characterized by high strength at room temperature and may be heat treated. The beta alloys may be annealed and heat treated and have superior weldability and formability but has less thermal stability at elevated temperatures.

SUMMARY OF THE INVENTION

One of the objects of this invention is to provide a new and improved drilling apparatus for use in drilling arcuate holes in the earth of shorter radius, e.g., as short as 20 feet, than has been available heretofore.

It is another object of this invention to provide an arcuate wellbore drilling system which may be used in very short radius wellbore applications without interfering with the wall of the borehole.

Another object of this invention is to provide a new and improved drilling apparatus with a steering section and motor section capable of use in drilling holes in the earth of shorter radius than has been available heretofore.

Another object of this invention is to provide a new and improved drilling apparatus which is more flexible for use in drilling holes in the earth of shorter radius than has been available heretofore.

Another object of this invention is to provide an arcuate wellbore drilling system having a steering section with bent housing and a fluid-operated drill motor with a curved or bent drive section connected therebetween for rotating the drill bit independently of the drill string.

Still another object of this invention is to provide an arcuate wellbore drilling system having a steering section, drill collar, and motor stator housing of improved construction which permits drilling arcuately around a very short radius.

Still another object of this invention is to provide an arcuate wellbore drilling system having a steering section, drill collar, and motor stator housing of a material of construction which provides greater flexibility of the entire string to allow for drilling arcuately around a very short radius.

Still another object of this invention is to provide an arcuate wellbore drilling system having a steering section, drill collar, and motor stator housing of a material of construction which provides for multiple bends along the drill string and has greater flexibility of the entire string to allow for drilling arcuately around a very short radius.

Still another object of this invention is to provide an arcuate wellbore drilling system having a steering section, drill collar, and motor stator housing of a material of construction which provides for multiple bends along the drill string and has greater flexibility of the entire string to allow for drilling arcuately around a very short radius and which is of non-magnetic material permitting installation of the steering closer to or ahead of the drilling motor.

Yet another object of this invention is to provide an arcuate wellbore drilling system having a steering section, drill collar, and motor stator housing of a material of construction which provides for multiple bends along the drill string and has greater flexibility of the entire string to allow for drilling arcuately around a very short radius and which is of non-magnetic titanium permitting installation of the steering closer to or ahead of the drilling motor.

Yet another object of this invention is to provide a deviated wellbore drilling system which will reduce the problems associated with utilizing elongate straight fluid-operated drilling motors in directional drilling applications with little loss of power required to rotate the rotary bit at the bottom of the drill string.

Yet another object of this invention is to provide a deviated wellbore drilling system which will aid in obtaining and maintaining control and orientation of the drill bit.

A further object of this invention is to provide a new and improved steering section of titanium for arcuate and horizontal drilling apparatus for use in drilling holes in the earth of shorter radius than has been available heretofore.

A further object of this invention is to provide a new and improved drill collar of titanium for horizontal drilling apparatus for use in drilling holes in the earth of shorter radius than has been available heretofore.

A still further object of this invention is to provide a new and improved drilling motor stator of titanium for horizontal drilling apparatus for use in drilling holes in the earth of shorter radius than has been available heretofore.

A still further object of this invention is to provide a deviated wellbore drilling system which is simple in design, economical to manufacture, and reliable and durable in use.

Other objects of the invention will become apparent from time to time throughout the specification and claims as hereinafter related.

DESCRIPTION OF THE PREFERRED EMBODIMENT

Figure 1:
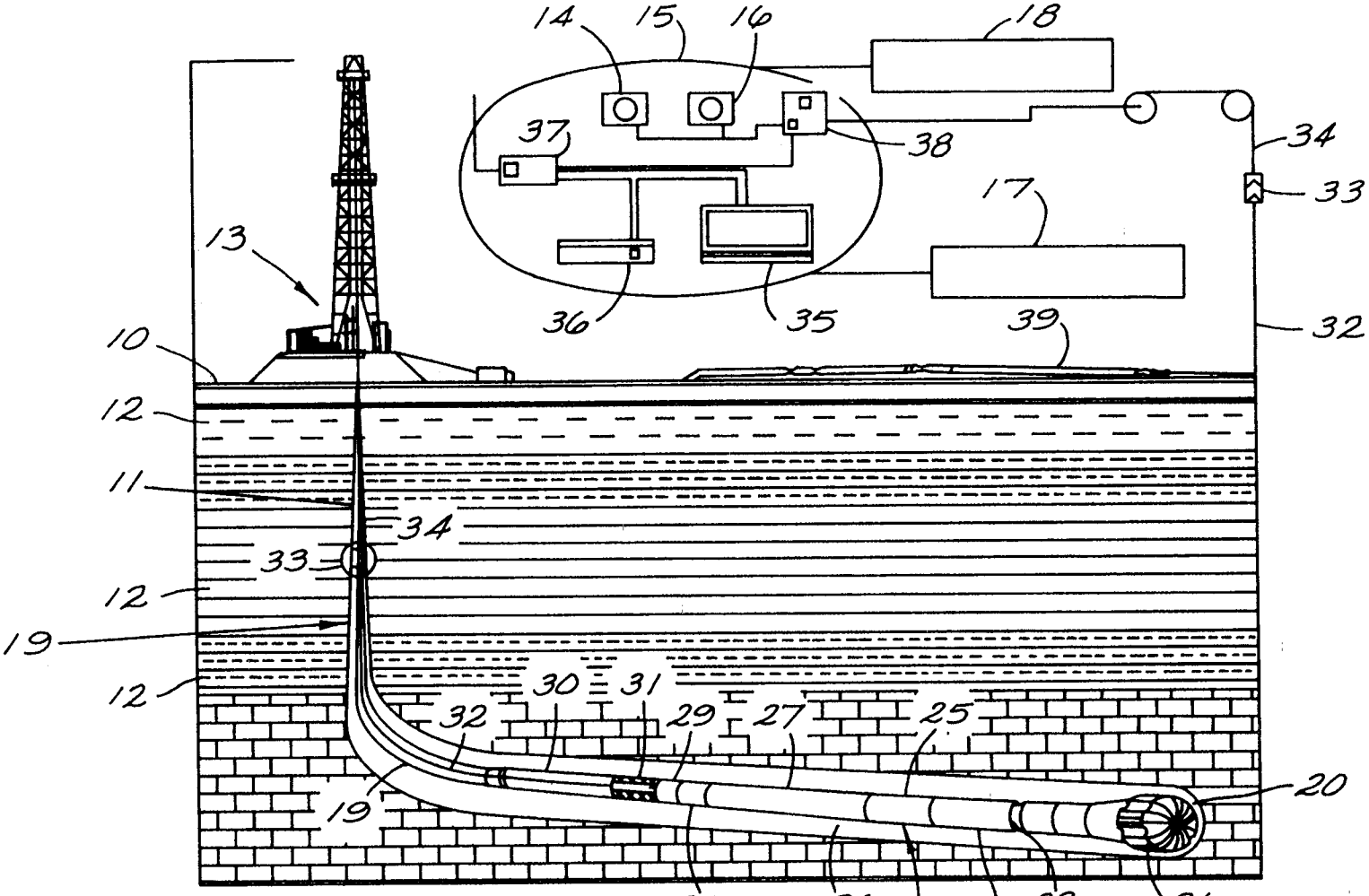
FIG. 1 is a sectional view through the earth showing schematically a novel assembly of components in the deviated or arcuate drilling apparatus comprising this invention.

Referring to the drawings by numerals of reference, there is shown an improved drilling apparatus for directional or arcuate drilling. FIG. 1 is a sectional view through the earth showing schematically a novel assembly of components in the deviated or arcuate drilling apparatus comprising this invention. FIGS. 2–8 show various portions of the apparatus in cross section.

In FIG. 1, there is shown a cross section through the earth showing the surface 10 and an open bore hole 11 extending through a plurality of strata 12. The drawing is not uniform in scale and the bore hole is exaggerated in scale toward the bottom to provide a better showing of the drilling components in operation. The apparatus includes the uphole read-out equipment (shown schematically), which includes the driller's console, interface box, printer, computer, and line conditioner; and the downhole equipment, which includes the wet connect system, wireline, steering tool running gear, and probe.

A drilling rig 13 is positioned on surface 10 and is rotatable to control movement of the drill string, i.e., the composite of drill pipe, tools, instruments, drilling motor, etc. used to drill and control direction of the hole. The surface-operated control and power equipment and instrumentation is located on driller's console 14 on the rig floor 15 and in trailer 16 and is connected to instrumentation and controls in the wireline truck 17. Read-out equipment 18 senses and records and controls the equipment by signals received from down hole.

The drill string 19 is best examined from the bottom 20 of the hole 11. Hole 11 is drilled by rotary drill bit 21 driven by drilling motor assembly 22. Drill bit 21 is driven by a shaft 23 extending through bearing section 24 connected below bent housing 25, with deflection plate 26 and driven by a positive-displacement motor 27 (also called a PDM).

A bent sub 28 connects the upper end of motor 27 to the lower end of orienting/circulating/float sub 29. A non-magnetic collar 30 is connected to the upper end of orienting/circulating/float sub 29 and encloses the survey tool 31. A wire line 32 connects survey tool 31 to wet-connects 33 and thence by wire line 34 to drilling rig 13 and associated instruments and controls.

At the surface, the instrumentation and control equipment includes computer 35, printer 36, line conditioner 37 and interface 38 (connected to wire line 34). Wire line 32 is shown connected to a steering tool 39 which is run down the wire and installed in the orienting sub for controlling movement of the drilling motor 27 and drill bit 21. The steering sub 39 is preferably of a flexible construction as shown in Roos et at U.S. patent application Ser. No. 07/925,100, filed Aug. 6, 1992.

Figure 2:
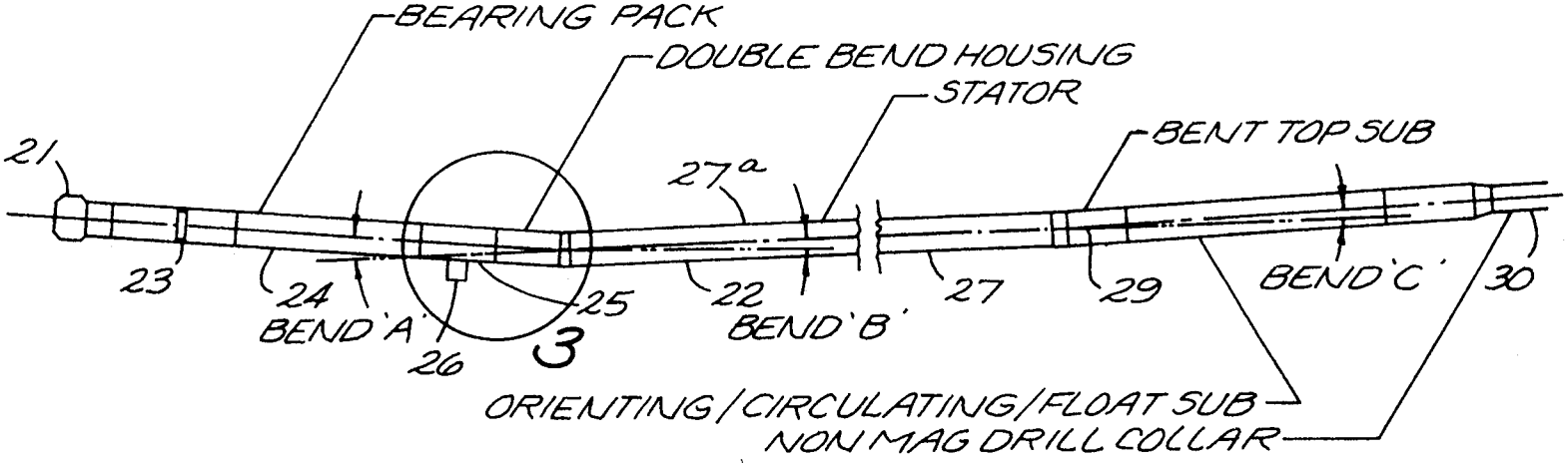
FIG. 2 is a view in elevation from the drill collar to the bearing pack showing multiple bends in the titanium components in the deviated or arcuate drilling apparatus comprising this invention.
Figure 3:
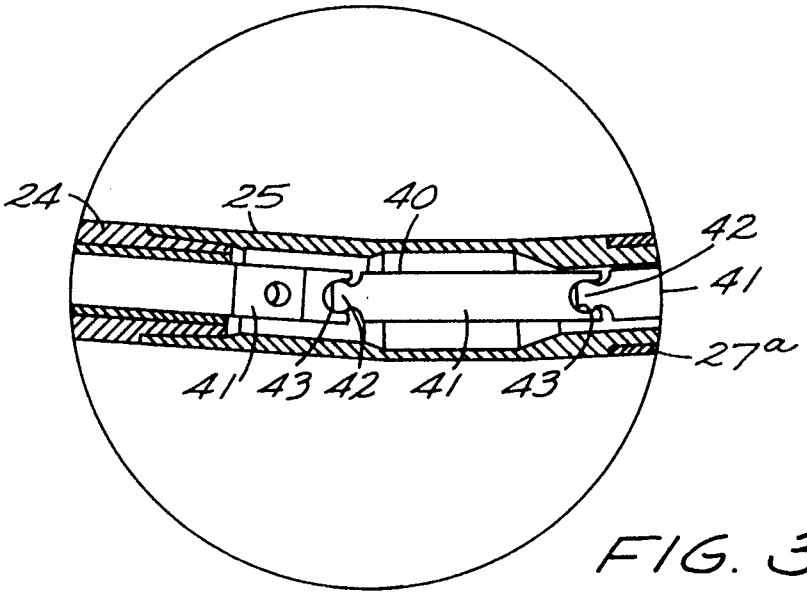
FIG. 3 is a sectional view of the titanium housing having multiple bends which includes a pivoted joint to transferring power from the motor rotor to the bearing pack and the drill bit.

The apparatus from the drill bit to the drill collar is shown in FIG. 2 on a slightly larger scale for better understanding of the invention. Rotary drill bit 21 is supported on and driven by drilling motor assembly 22. Motor assembly 22 comprising a bearing pack 24 through which a shaft 23 extends to support and rotate drill bit 21. Motor assembly has double bent construction comprising bent housing 25 with deflection plate 26. Bent housing 25 is connected to PDM 27 comprising a stator housing 27*a* and a rotor (not shown). The drive shaft extending through bent housing 25 is a composite shaft 40 comprising a plurality of shaft members 41 with tongue 42 in groove 43 (non-rotatable) connections permitting the shaft to flex while rotating and providing a universal connection from the gyrating end of the motor rotor to the drill bit.

Figure 4A:
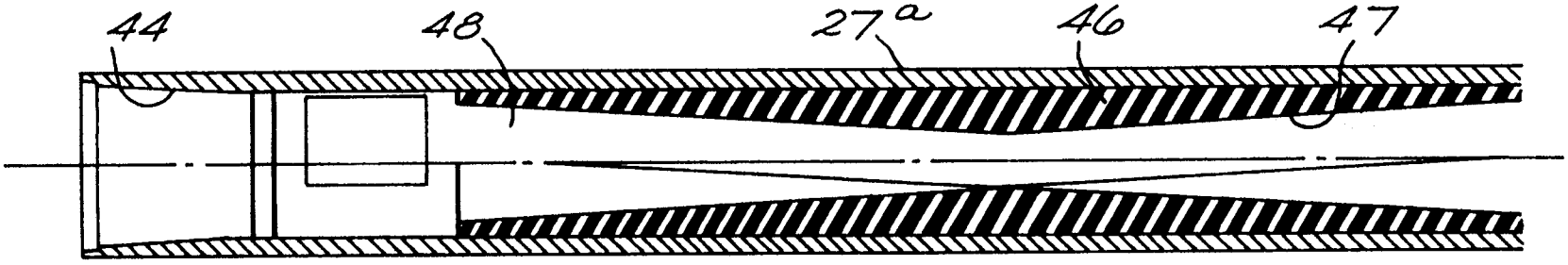
FIGS. 4A and 4B taken together constitute a longitudinal sectional view showing details of the titanium drill motor stator and rotor therefor used in this invention.
Figure 4B:
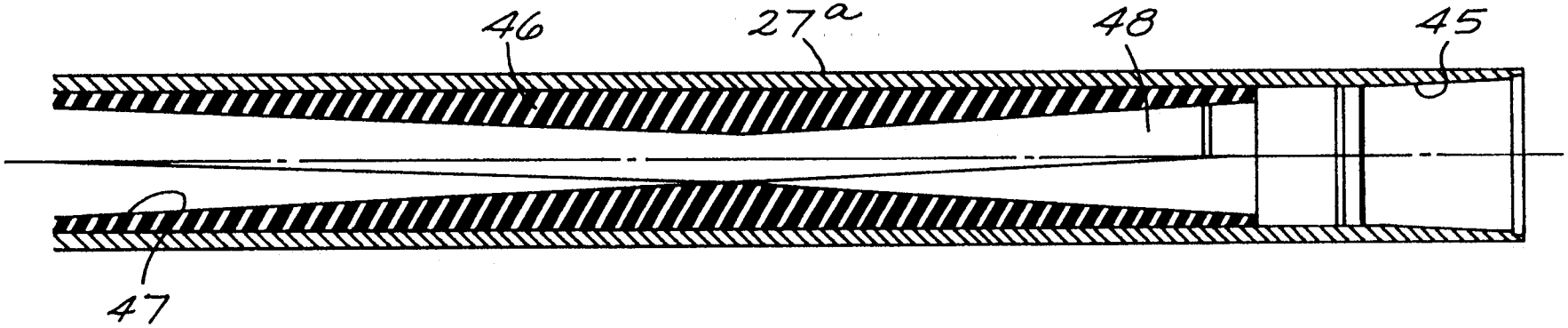

The PDM 27 is shown in more detail in FIGS. 4*a* and 4*b*. PDM 27 is a Moineau motor comprising stator housing 27*a* of beta-titanium alloy having box threads 44 and 45 at opposite ends for connection respectively to lower bent sub 25 and upper bent sub 29.

The alloy is Beta-C titanium alloy (Ti-3Al-8V-6Cr-4Zr-4Mo), annealed 115,000/120,000 psi. yield, 135,000 psi. tensile, 15–18% elongation, 15.0 modulus of elasticity. This alloy or equivalent is used wherever beta-titanium alloy is mentioned unless otherwise stated. Due to the modulus of elasticity, this alloy can be deflected twice as much as steel and encounter the same stress levels. This characteristic provides advantages in applications such as drilling short radius well bores using the recommended drill bit size for standard well casings, applications where steel tubular strings run in short radius well bores where high deflection and low stress levels of bottom hole assembly parts are desired. This alloy is non-magnetic, therefore steering tools can be run closer to the bit. The strength characteristics of this alloy is comparable to 4140 heat treated steel or K-Monel which makes it an excellent choice for downhole drilling equipment.

Stator 46 is of rubber (or other elastomeric) construction having a helical cavity 47. Steel rotor 48 has a helical (Moineau) configuration which cooperates with stator cavity 47 to provide a gyrating cavity during operation. The stator housing 27 and stator 46 is bent at two or more points along its length but the rotorshaft 48 has a straight axis. The flexibility of rotor shaft 48 and compressibility of the rubber stator 46 permit rotation of the rotor without undue binding. The beta-titanium provides the required amount of strength and oxidation resistance and is capable of taking the required amount of bending and flexing in use to prevent fatigue failure. The titanium alloy has mechanical properties which allow the motor to bend through the tight curvature of short radius wells without overstressing the metal thereby allowing full length motor sections with high torque capability in the horizontal portion of the well bore. The flexibility is such that motors with several bends designed with high angle bent housings and subs can be pushed into the casing of the vertical portion of the well bore without over stressing the bends. This allows larger bits to be used with those motors than could be used with alloy steel stator housings. The non-magnetic character of the titanium alloy permits the steering tool probe to be positioned closer to the drill bit by the length of the motor housing which allows for more accurate control of the drilling from the surface.

Figure 5A:
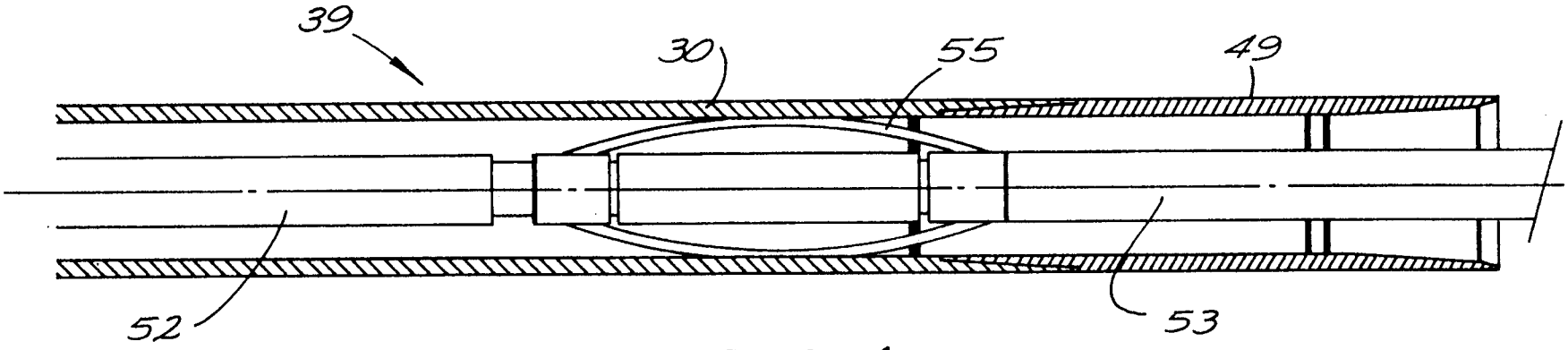
FIGS. 5A and 5B taken together constitute a longitudinal sectional view of the titanium drill collar which houses the steering tool or directional survey tool used in this invention.
Figure 5B:
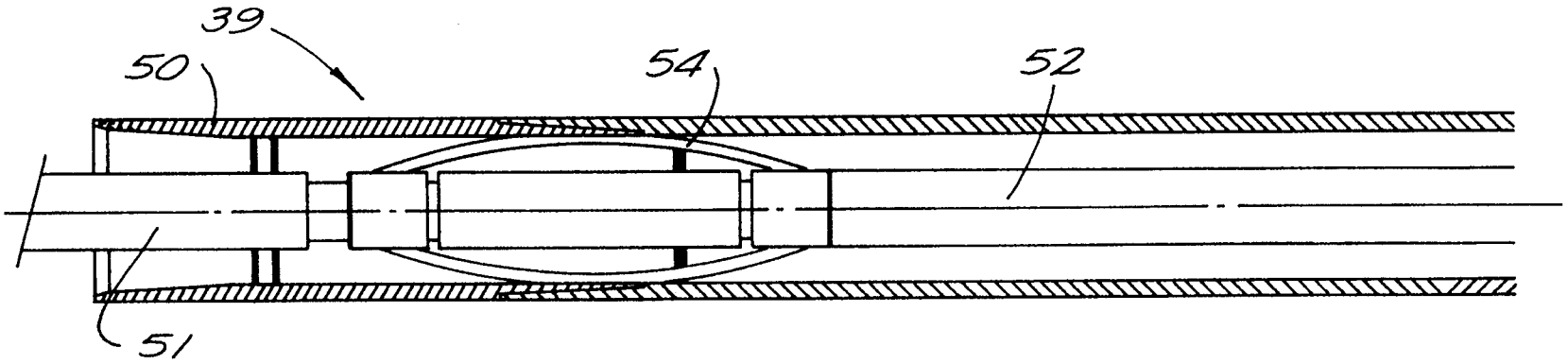

Drill collar 30 is shown in FIGS. 5A and 5B on a slightly larger scale and houses the steering tool assembly 39 (also shown schematically on the surface at the drill rig floor). Drill collar 30 is of non-magnetic beta-titanium alloy and has box-threaded tool joints 49 and 50 at opposite ends for connection in the drill string. The alloy is Beta-C titanium alloy (Ti-3Al-8V-6Cr-4-Zr-4-Mo), annealed 115,000/120,000 psi. yield, 135,000 psi. tensile, 15–18% elongation, 15.0 modulus of elasticity. This alloy or equivalent is used wherever beta-titanium alloy is mentioned unless otherwise stated. Due to the modulus of elasticity, this alloy can be deflected twice as much as steel and encounter the same stress levels. This characteristic provides advantages in applications such as drilling short radius well bores using the recommended drill bit size for standard well casings, applications where steel tubular strings run in short radius well bores where high deflection and low stress levels of bottom hole assembly parts are desired. This alloy is non-magnetic, therefore steering tools can be run closer to the bit. The strength characteristic of this alloy is comparable to 4140 heat treated steel or K-Monel which makes it an excellent choice for downhole drilling equipment. The titanium alloy has mechanical properties which allow the drill collar to bend through the tight curvature of short radius (down to 20 ft. radius) wells without overstressing the metal thereby allowing directional surveys to be taken without tripping out of the hole. With the steering tool always being seated in the drill string, a more accurate and precise well bore can be drilled. Steering tool assembly 39 is the structure shown in Roos et al U.S. patent application Ser. No. 07/925,100. Steering tool has sections 51, 52 and 53 articulated through bow spring members 54 and 55. The lower and upper sections are designed to bend in preference to the pressure barrel sections. Sections 51, 52 and 53 enclose a probe and an electronics package and electrical connection feed through system which requires a single connect to the wireline to complete the downhole electrical system. The drill collar may be constructed with the tool joints on each end of titanium or alloy steel secured by threaded connection or by welding or as a one piece construction, as described below for the construction of non-magnetic titanium alloy drill pipe.

Figure 6A:
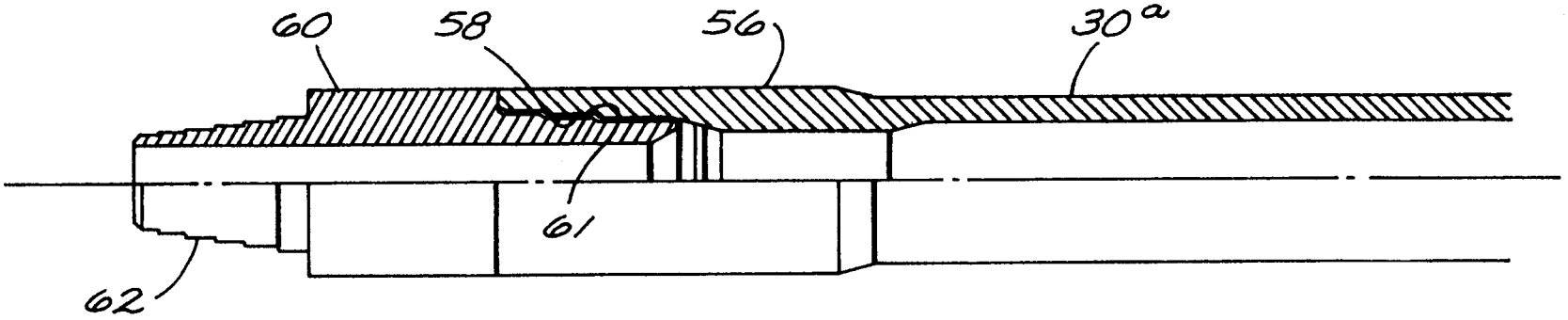
FIGS. 6A and 6B taken together constitute a longitudinal sectional view of a titanium drill pipe used in this invention having pin and box subs at the ends thereof secured in the pipe by threaded connection.
Figure 6B:
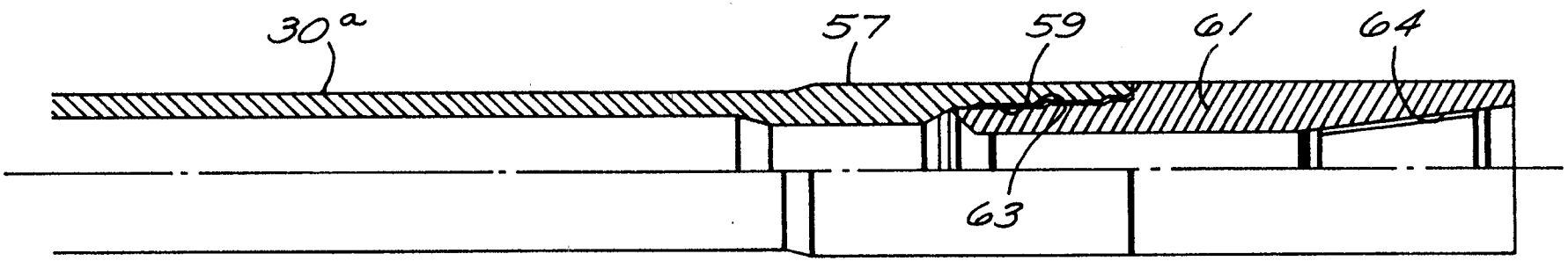

A non-magnetic drill pipe used in making up the drill string may be of three different designs as shown in FIGS. 6A and 6B; 7A and 7B; and 8A and 8B. The titanium alloy has mechanical properties which allow the drill collar to bend through the tight curvature of short radius (down to 20 ft. radius) wells without overstressing the metal. The drill pipe is installed above the non-magnetic titanium alloy drill collar and the short radius motor and drill bit assembly. The drill pipe acts as a conveyance system for pushing and pulling the bottom hole assemblies through the tight curvatures of short radius (down to 20 ft. radius) wells. The drill pipe also provides a passage for lowering or raising the short radius steering tool to or from the drill collar. The alloy is Beta-C titanium alloy (Ti-3Al-8V-6Cr-4Zr-4Mo), annealed 115,000/120,000 psi. yield, 135,000 psi. tensile, 15–18% elongation, 15.0 modulus of elasticity. This alloy or equivalent is used wherever beta-titanium alloy is mentioned unless otherwise stated. Due to the modulus of elasticity, this alloy can be deflected twice as much as steel and encounter the same stress levels. This characteristic provides advantages in applications such as drilling short radius well bores using the recommended drill bit size for standard well casings, applications where steel tubular strings run in short radius well ores where high deflection and stress levels of bottom hole assembly parts are desired. This alloy is non-magnetic, therefore steering tools can be run closer to the bit. The strength characteristics of this alloy is comparable to 4140 heat treated steel or K-Monel which makes it an excellent choice for downhole drilling equipment.

The drill pipe 30*a* of FIGS. 6A and 6B is of beta-titanium alloy and has enlarged ends 56 and 57 with box threads 58 and 59. Tool joint 60 has a pin thread 61 connected in box thread 58 and a pin thread 62 for connection in the drill string. Tool joint 61 has a pin thread 63 connected in box thread 59 and a box thread 63 for connection in the drill string.

Figure 7A:
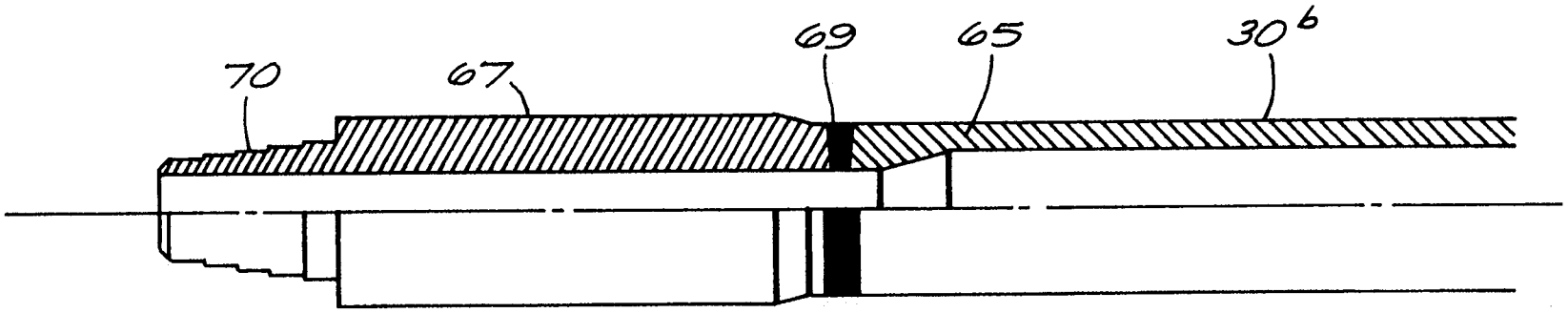
FIGS. 7A and 7B taken together constitute a longitudinal sectional view of a titanium drill pipe used in this invention having pin and box subs at the ends thereof welded in place therein.
Figure 7B:
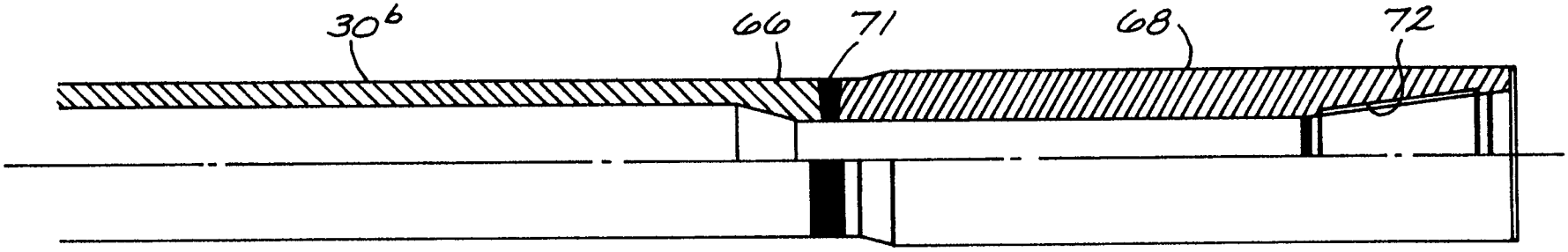

The drill collar 30*b* of FIGS. 7A and 7B is of beta-titanium alloy and has enlarged ends 65 and 66 for connection to tool joints 67 and 68. Tool joint 67 is welded to enlarged end 65 as indicated at 69 and has a pin thread 70 for connection in the drill string. Tool joint 68 is welded to enlarged end 66 as indicated at 71 and has a box thread 72 for connection to the bearing pack.

Figure 8A:
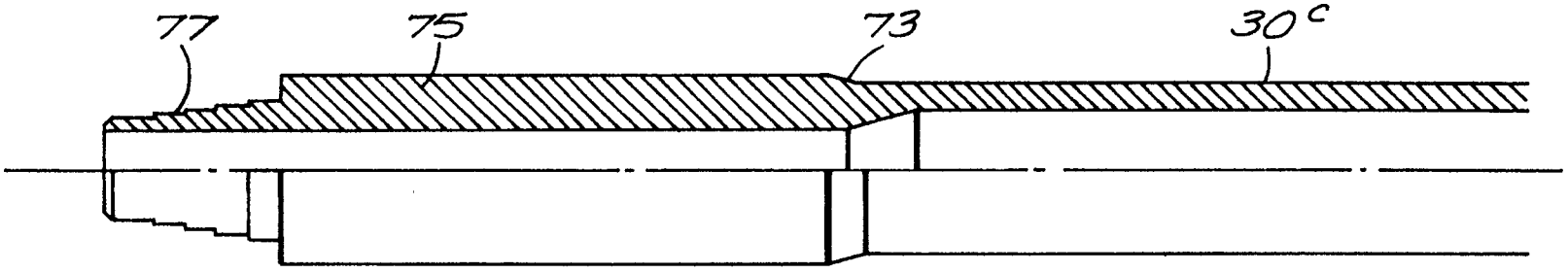
FIGS. 8A and 8B taken together constitute a longitudinal sectional view of a titanium drill pipe used in this invention having pin and box subs at the ends formed integrally with the pipe as an unseamed, non-welded integral construction.
Figure 8B:
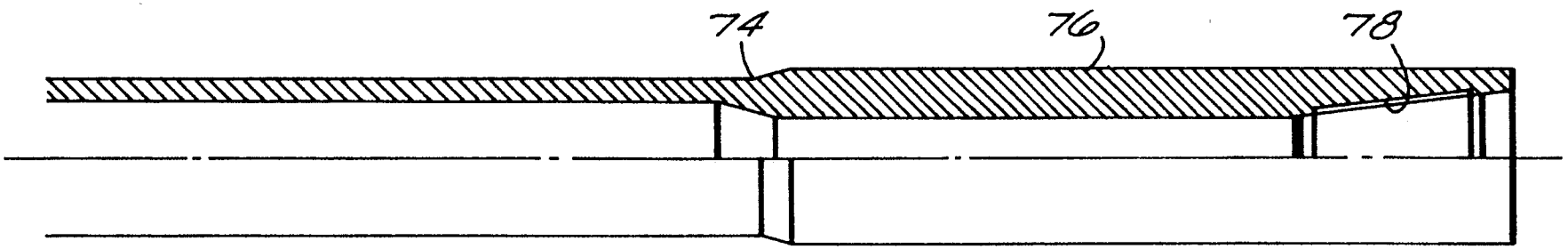

The drill collar 30*c* of FIGS. 8A and 8B is of beta-titanium alloy and is of a one piece forged construction. The tool joints are forged integrally with the drill collar and have internal or external upsets. Drill collar 30*c* has enlarged ends 73 and 74 formed integrally with tool joints 75 and 76 having pin thread 77 and box thread 78 respectively.

The tool joints 60 and 61 of FIGS. 6A and 6B and the tool joints 67 and 68 of FIGS. 7A and 7B may be of beta-titanium alloy or may be of stainless steel or other suitable alloy for connection in the drill string. As noted above, the tool joints 75 and 76 of FIGS. 8A and 8B are formed integrally with the main body of the drill collar.

OPERATION

The short radius directional tool as seen in FIG. 1 and the details of the components shown in FIGS. 2–8 is designed for short radius directional and horizontal drilling applications. The tool is engineered to eliminate overstress due to high angle bending found in short radius curvatures. Overstress can cause equipment failure due to collapse which in turn will cause electrical component damage to the electronic probe sections. The short radius drilling apparatus is engineered to bend in preferred or preferential sections thereby eliminating the problem of overstress at particular locations. The bending will occur in the preferred sections permitting overall uniform bending of the apparatus without damage.

A fluid, usually a relatively incompressible liquid, is forced down the stationary drill pipe or drill string and on passing through the fluid-operated motor causes the rotor thereof to rotate the drilling bit. The drill string is held or suspended in such a manner that it does not rotate and therefore may be regarded as stationary and the drill string is lowered in the well as drilling proceeds.

Although rotor/stator section of the motor is approximately 2–3 times longer than the bearing pack section, the bent or curved section is located in the long drive section of the motor between the drill pipe and the universal section of the motor. In this manner, the bit or output shaft is angularly offset relative to the drive pipe axis over a sufficient linear distance making it particularly suitable for use in drilling high curvature horizontal wellbores, such as short-radius (down to 20 feet) from vertical or near vertical wells.

Tests conducted on motors according to the present invention which have sharp bends or curved rotor-stator drive sections have demonstrated that they deliver approximately 90 to 95 percent as much power as motors having a straight drive section, therefore loss of power is not a significant problem.

This steering tool and the associated equipment completing the survey system was for horizontal application. The guidance system has the ability to survey short radius curvatures along with medium length and long length lateral sections. The steering tool and survey system was successfully field tested when it recently directed a drill string through a seventy foot radius and then through one thousand feet of lateral section to completion. The following conclusions were drawn from the field test. Short radius curves with long lateral sections are feasible and economical. The use of a wet connect system extends the lateral section well beyond 1000 ft. The short radius stabilization system worked as designed keeping vibrations to a minimum while giving the drilling engineer the ability to survey as needed within the high angle curve section. The component parts of the short radius survey tool bend in preference to the pressure barrel sections making the tool perform as designed and engineered.

While this invention has been described fully and completely with special emphasis on certain preferred embodiments, it should be understood that within the scope of the appended claims the invention may be practiced otherwise than as specifically described.

We claim:

1. A system of apparatus for arcuate drilling into the earth comprising:

a drill string extending into a well bore in the earth, a fluid operated drill motor and drill bit operated thereby secured on the bottom end of said drill string, said drill motor being connected at its upper end to said drill string and at its lower end to said drill bit for rotating said drill bit independently of rotation of said drill string, said drill motor having a tubular drive section housing constructed of non-magnetic material with the longitudinal axis of its upper and lower ends angularly displaced from the longitudinal axis of its central portion end for directing the axis of rotation of said drill bit such that it is angularly displaced from the axis of said drill string for effecting a curved path for said wellbore, an orienting/circulating/float sub constructed of non-magnetic material connected above said drill motor, a drill collar constructed of non-magnetic material connected to the upper end of said orienting/circulating/float sub, a survey tool positioned in and surrounded by said orienting/circulating/float sub, a drilling rig, instruments and controls positioned on the earth surface, a first wire line connecting said survey tool a predetermined distance toward the earth surface, a second wire line connecting instruments and controls positioned on the earth surface a predetermined distance into said drill string, and a wet-connect releasably connecting said first and said second wire lines, wherein the structure and configuration of the respective components cooperate to facilitate bending through a radius of curvature as short as 20 feet.

2. A system of apparatus for arcuate drilling into the earth according to claim 1 in which said drill motor housing is of a titanium alloy.

3. A system of apparatus for arcuate drilling into the earth according to claim 1 in which said drill motor housing is of a beta-titanium alloy.

4. A system of apparatus for arcuate drilling into the earth according to claim 1 in which said drill motor housing is of Beta-C titanium alloy containing titanium, aluminum, vanadium, chromium, zirconium and molybdenum.

5. A system of apparatus for arcuate drilling into the earth according to claim 1 in which said drill motor housing is of Beta-C titanium alloy containing titanium, aluminum, vanadium, chromium, zirconium and molybdenum in the proportions Ti-3Al-8V-6Cr-4Zr-4Mo, annealed 115,000/120,000 psi. yield, 135,000 psi. tensile, 15–18% elongation, and 15.0 modulus of elasticity.

6. A system of apparatus for arcuate drilling into the earth according to claim 1 in which said orienting/circulating/float sub is of a titanium alloy.

7. A system of apparatus for arcuate drilling into the earth according to claim 1 in which said orienting/circulating/float sub is of a beta-titanium alloy.

8. A system of apparatus for arcuate drilling into the earth according to claim 1 in which said orienting/circulating/float sub is of Beta-C titanium alloy containing titanium, aluminum, vanadium, chromium, zirconium and molybdenum.

9. A system of apparatus for arcuate drilling into the earth according to claim 1 in which said orienting/circulating/float sub is of Beta-C titanium alloy containing titanium, aluminum, vanadium, chromium, zirconium and molybdenum in the proportions Ti-3Al-8V-6Cr-4Zr-4Mo, annealed 115,000/120,000 psi. yield, 135,000 psi. tensile, 15–18% elongation, and 15.0 modulus of elasticity.

10. A system of apparatus for arcuate drilling into the earth according to claim 1 in which said drill collar is of a titanium alloy.

11. A system of apparatus for arcuate drilling into the earth according to claim 1 in which said drill collar is of beta-titanium alloy.

12. A system of apparatus for arcuate drilling into the earth according to claim 1 in which said drill collar is of Beta-C titanium alloy containing titanium, aluminum, vanadium, chromium, zirconium and molybdenum.

13. A system of apparatus for arcuate drilling into the earth according to claim 1 in which said drill collar is of Beta-C titanium alloy containing titanium, aluminum, vanadium, chromium, zirconium and molybdenum in the proportions Ti-3Al-8V-6Cr-4Zr-4Mo, annealed 115,000/120,000 psi. yield, 135,000 psi. tensile, 15–18% elongation, and 15.0 modulus of elasticity.

14. A system of apparatus for arcuate drilling into the earth according to claim 1 in which said drill motor is of a double bend construction, including a bent housing, having a rubber stator and steel rotor of Moineau helical configuration and a bent sub attached to said bent housing.

15. A system of apparatus for arcuate drilling into the earth according to claim 1 in which said drill motor is of a double bend construction, including a bent housing, having a rubber stator and steel rotor of Moineau helical configuration and a bent sub attached to said bent housing, said housing and sub being of titanium alloy.

16. A system of apparatus for arcuate drilling into the earth according to claim 1 in which said drill motor is of a double bend construction, including a bent housing, having a rubber stator and steel rotor of Moineau helical configuration and a bent sub attached to said bent housing, said housing and sub being of Beta-C titanium alloy.

17. A system of apparatus for arcuate drilling into the earth according to claim 1 in which said drill collar is of a one-piece construction with threaded ends of titanium alloy.

18. A system of apparatus for arcuate drilling into the earth according to claim 1 in which said drill collar has a tubular body portion of titanium alloy and threaded end members welded to said body portion.

19. A system of apparatus for arcuate drilling into the earth according to claim 1 in which said drill collar has a tubular body portion of titanium alloy and threaded end members of steel welded to said body portion.

20. A system of apparatus for arcuate drilling into the earth according to claim 1 in which said drill collar has a tubular body portion of titanium alloy and threaded end members of titanium alloy welded to said body portion.

21. A system of apparatus for arcuate drilling into the earth comprising:

a drill string extending into a well bore in the earth, a fluid operated drill motor and drill bit operated thereby secured on the bottom end of said drill string, said drill motor being connected at its upper end to said drill string and at its lower end to said drill bit for rotating said drill bit independently of rotation of said drill string, said drill motor having a tubular drive section housing constructed of titanium alloy with the longitudinal axis of its upper and lower ends angularly displaced from the longitudinal axis of its central portion end for directing the axis of rotation of said drill bit such that it is angularly displaced from the axis of said drill string for effecting a curved path for said wellbore, an orienting/circulating/float sub constructed of titanium alloy connected above said drill motor, a drill collar constructed of titanium alloy connected to the upper end of said orienting/circulating/float sub, a survey tool positioned in and surrounded by said orienting/circulating/float sub, a drilling rig, instruments and controls positioned on the earth surface, a first wire line connecting said survey tool a predetermined distance toward the earth surface, a second wire line connecting instruments and controls positioned on the earth surface a predetermined distance into said drill string, and a wet-connect releasably connecting said first and said second wire lines, wherein the structure and configuration of the respective components cooperate to facilitate bending through a radius of curvature as short as 20 feet.

22. A system of apparatus for arcuate drilling into the earth according to claim 21 in which said titanium alloy is a beta-titanium alloy.

23. A system of apparatus for arcuate drilling into the earth according to claim 21 in which said titanium alloy is Beta-C titanium alloy containing titanium, aluminum, vanadium, chromium, zirconium and molybdenum.

24. A system of apparatus for arcuate drilling into the earth according to claim 21 in which said titanium alloy is Beta-C titanium alloy containing titanium, aluminum, vanadium, chromium, zirconium and molybdenum in the proportions Ti-3Al-3V-6Cr-4Zr-4Mo, annealed 115,000/120,000 psi. yield, 135,000 psi. tensile, 15–18% elongation, and 15.0 modulus of elasticity.

* * * * *